US008056270B1

(12) United States Patent
Maitlen et al.

(10) Patent No.: US 8,056,270 B1
(45) Date of Patent: Nov. 15, 2011

(54) DREDGE PROPULSION SYSTEM

(76) Inventors: Cash Maitlen, Cushing, OK (US); Mason Maitlen, Cushing, OK (US)

( * ) Notice: Subject to any disclaimer, the term of this patent is extended or adjusted under 35 U.S.C. 154(b) by 44 days.

(21) Appl. No.: 12/823,585

(22) Filed: Jun. 25, 2010

(51) Int. Cl.
*E02D 17/16* (2006.01)
*E02F 9/00* (2006.01)

(52) U.S. Cl. ..... 37/345

(58) Field of Classification Search ..... 37/312, 37/317, 320, 340–346; 440/36, 41, 91; 405/117, 405/258, 303
See application file for complete search history.

(56) References Cited

U.S. PATENT DOCUMENTS

| | | | | | |
|---|---|---|---|---|---|
| 193,511 | A * | 7/1877 | Hetzler | 440/36 |
| 2,993,463 | A * | 7/1961 | McKinney | 440/41 |
| 3,170,437 | A * | 2/1965 | Kilmer | 440/91 |
| 3,755,932 | A | 9/1973 | Cargile, Jr. | |
| 4,676,052 | A | 6/1987 | Hawk | |
| 4,713,896 | A | 12/1987 | Jennens | |
| 4,896,445 | A * | 1/1990 | Deal | 37/195 |
| 5,279,012 | A | 1/1994 | Sloan | |
| 5,782,660 | A | 7/1998 | Brickell et al. | |
| 5,791,074 | A * | 8/1998 | Pryor | 37/345 |
| 5,970,634 | A | 10/1999 | Dann et al. | |
| 6,755,701 | B2 | 6/2004 | Dornier, II et al. | |
| 7,556,544 | B2 | 7/2009 | Zimmerlee | |

* cited by examiner

*Primary Examiner* — Robert Pezzuto
(74) *Attorney, Agent, or Firm* — Gable Gotwals

(57) ABSTRACT

A dredge propulsion system mounted on the same boom as the cutter head. The propulsion system has one or more augers which can be operated individually to maneuver the dredge. In the preferred embodiment a pair of augers are mounted parallel to one another on a subframe which is connected to the boom of the cutter head. The subframe comprises a first member pivotally attached to the boom. Each auger is carried by a three bar linkage mounted to the first member.

10 Claims, 5 Drawing Sheets

DREDGE PROPULSION SYSTEM

1. FIELD OF THE INVENTION

The present invention is a propulsion system for a dredge. More specifically, a propulsion system utilizing one or more augers.

2. BACKGROUND OF THE INVENTION

Dredges are commonly used to remove sediments from the bottom of various bodies of water. This can involve everything from dredging sand from a river bottom to removing sludge from sludge pits.

Dredges typically have a hull which floats on top of the water. A boom with a cutter head is pivotally attached to the hull. When it is in the lowered position, the cutter head can be operated in combination with a pump to remove a slurry of material from the bottom of the body of water.

The operation of the cutter head requires a significant amount of force to stir and agitate the material on the bottom. Thus traditionally dredges have been located and moved using a set of cables spanning the body of water being dredged. The dredge traverses the body of water either by taking in and paying out cable using winches mounted on the dredge or by traveling along a single cable with a winch mounted on the dredge. Thus the dredge is limited in its scope of operation to a path of traversing the cables. In order to dredge additional areas the anchors on the end of the cables must be moved so that the dredge can traverse a new swath or path of area across the body of water. As one can imagine relocating a dredge in this manner can be very time consuming.

In addition to the time consuming nature of moving such a dredge, the cables also present a hazard to nearby boats and vessels. If the cables are overhead, they can severely limit the height of vessels able to operate adjacent to the dredge. Similarly if the cables are anchored underwater they present an unseen hazard to the other vessels operating in the area. This greatly reduces the depth of draft a vessel can have and safely operate in the area.

Other parties have seen the shortcomings of navigating dredges using such a cable system and have resorted to use of paddle wheels, however the paddle wheels only work when they are on the surface of the water or engaged with the bottom of the body of water. Dredges using paddle wheels will not work when the paddle wheels are not in either of these locations.

Further the paddle wheels are located on their own individual booms which can be raised and lowered. This is in addition to the boom to which the cutter head is mounted. During operation the forces exerted by the cutter head as well as those exerted by the paddle wheels must operate from the long lever arm created by the booms to which they are attached. This makes it very difficult to control the position of the dredge and often times the dredges equipped with such paddle wheels are operated with a cable and winch system in addition to the paddle wheels.

The dredge industry has thus had a long felt need for a propulsion system which can maneuver a dredge and also hold it in place while in operation. Further what is needed is a dredge propulsion system which can be quickly and easily used to maneuver about the body of water being dredged without having to relocate cables and anchors.

Additionally what is needed is a dredge propulsion system which does not present underwater and overhead hazards to surrounding vessels.

BRIEF SUMMARY OF THE INVENTION

The present invention is a dredge propulsion system mounted on the same boom as the cutter head. The propulsion system has one or more augers which can be operated individually to maneuver the dredge. In the preferred embodiment a pair a parallel augers are mounted on a subframe which is connected to the boom of the cutter head. The subframe comprises a first member pivotally attached to the boom. Each auger is carried by a three bar linkage mounted to the first member.

The present invention allows the dredge to be relocated anywhere within a given body of water without relocating anchors and cable lines.

Further, the present invention allows for maneuvering of a dredge without presenting overhead or underwater obstacles for surrounding vessels.

Additionally the propulsion system of the present invention can maneuver the dredge regardless of whether or not the augers are on the top surface of the body of water, on the bottom surface or somewhere in between.

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION OF THE PREFERRED EMBODIMENT(S)

Figure 1:
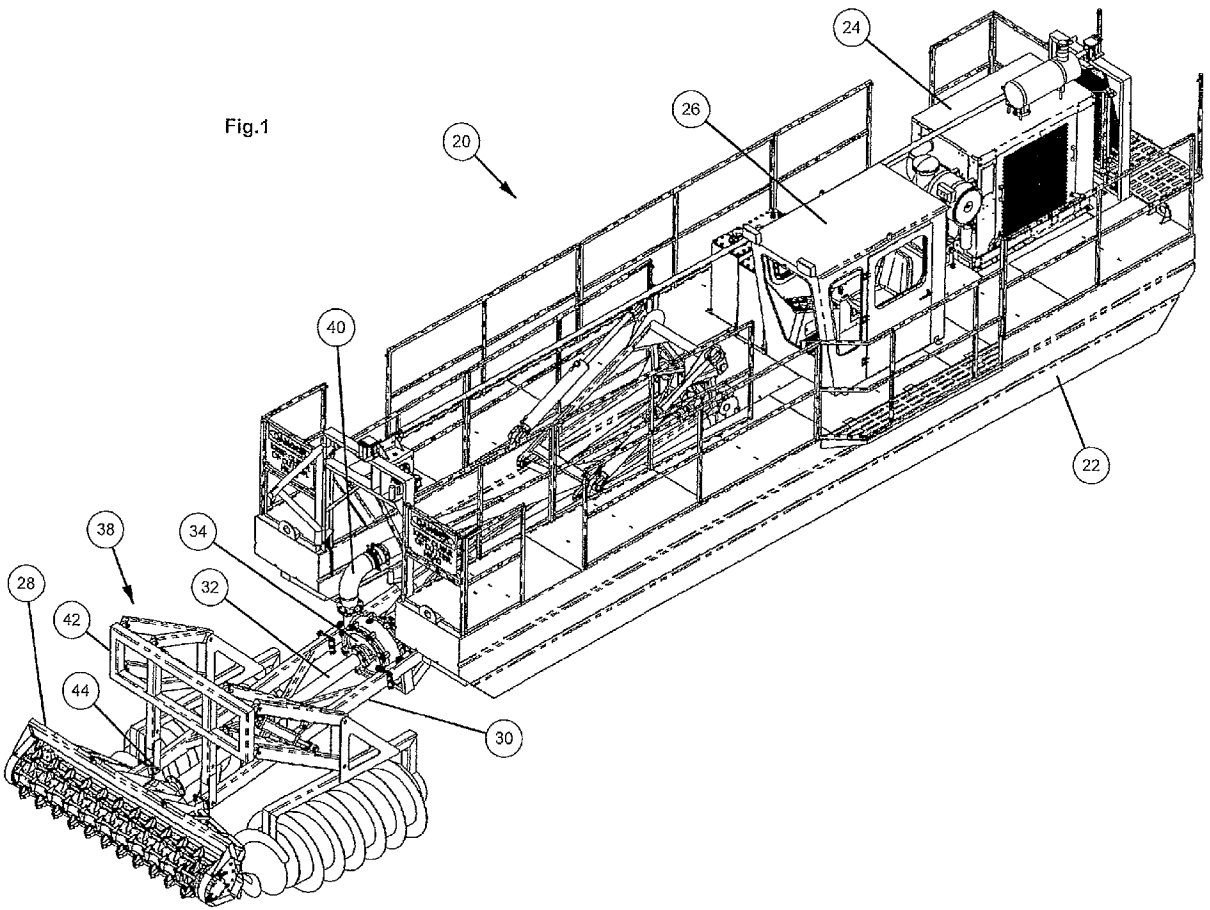
FIG. 1 is a perspective view of a dredge with the present invention and its boom near the fully raised position.
Figure 2:
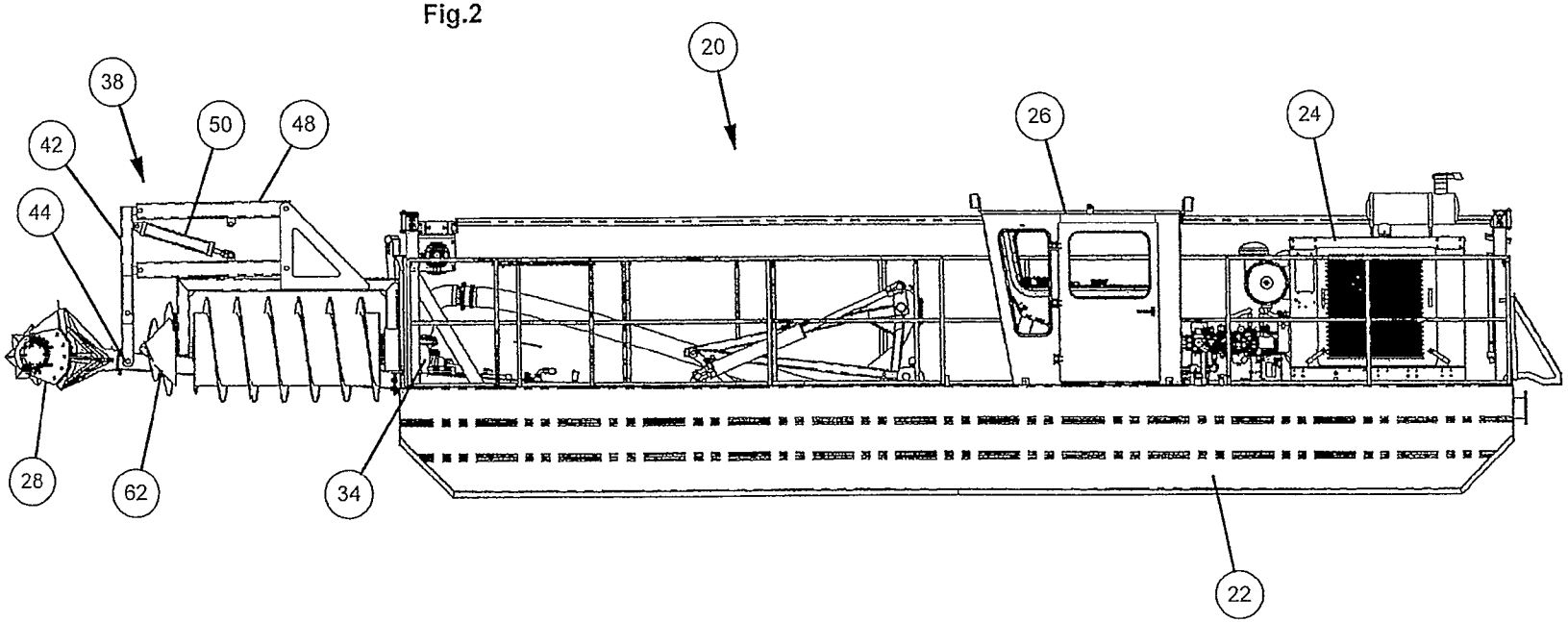
FIG. 2 is a is a side view of a dredge with the present invention and its boom in the raised position.
Figure 3:
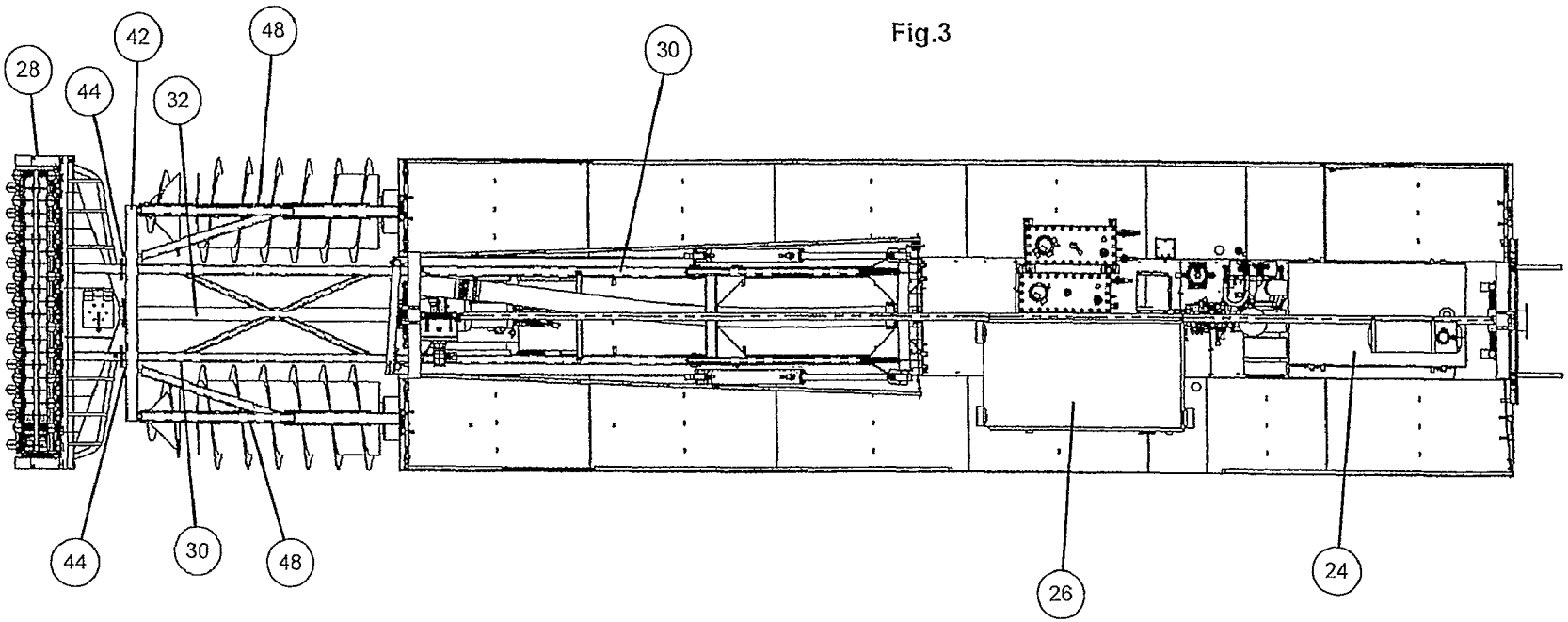
FIG. 3 is a top view of a dredge with the present invention and its boom in the raised position.

Turning now to FIG. 1 which shows a perspective view of a dredge 20 with the present invention. The dredge 20 has a hull 22, power plant 24 and helm 26. The cutter head 28 is located on the boom 30. An intake 32 leads from the cutter head 28 to a pump 34. A pair of augers 36 are carried by a subframe 38 which allows the height and pitch of the augers 36 to be varied relative to the boom 30.

In the preferred embodiment as seen in the drawings there are two augers 36 parallel with one another. The flightings on the augers 36 are opposite rotations from one another to help maintain straight line stability. Therefore, the augers 36 turn in opposite rotational directions to propel the dredge forward or rearward. This allows the sideward forces generated by the rotation of the augers 36 to cancel out one another and ensure straight forward and rearward movement.

When in use an operator located in the helm 26 controls the operation of the dredge. With the boom 30 in a raised position as shown in FIG. 1, the operator can swim the dredge 20 out to a desired spot by putting the augers 36 in rotational movement. The thrust from the water as it moves through the augers 36 propels the dredge 20 across the water. The dredge 20 can be moved forward or rearward by operating the augers 36 in the opposite rotational directions. Similarly the dredge 20 can be turned either to port or starboard by operating the augers 36 in the same rotational direction relative to one another or by operating one auger 36 faster than the other in opposite rotational directions.

Figure 4:
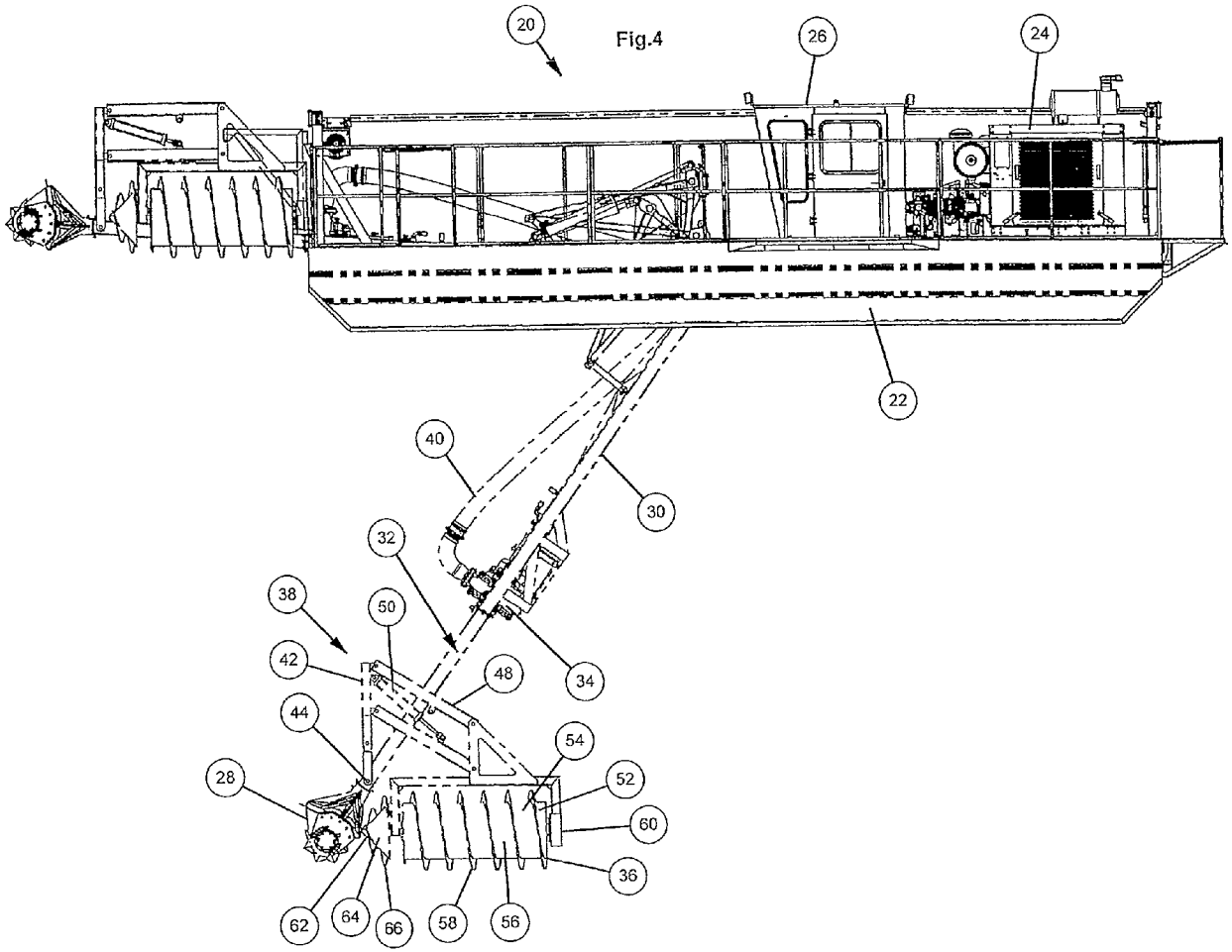
FIG. 4 is a side view of a dredge with the present invention and its boom in the raised and lowered positions.

Once in position the boom 30 can be lowered as seen in FIG. 4. This places the cutter head 28 in contact with the bottom or floor of the body of water being dredged. The operator can then start the pump 34 and the rotation of the cutter head 28. These typically are operated by hydraulic powered motors. The hydraulic power is typically provided by the power plant 24. Other means of operating the cutter head 28 and pump 34 could also be used including but not limited to mechanical drives, pneumatic motors or seal electric motors. As the cutter head 28 rotates it breaks up sediment from the bottom of the body of water. At the same time water surrounding the cutter head 28 is captured or sucked into the intake 32 and through the pump 34. This creates a slurry of water and sediment which can then be pumped to a desired location through hoses attached to the pump outlet 40.

With the boom 30 in the lower position, as shown in FIG. 4, the subframe 38 can be tilted to put the augers 36 in contact with the floor of the body of water. The operator can then maneuver the dredge 20 by rotating the augers 36 about their center axis. The dredge 20 can be moved forward or rearward by operating the augers 36 in the opposite rotational directions relative to one another. Similarly the dredge 20 can be turned either to port or starboard by operating the augers 36 in the same rotational direction.

Figure 5:
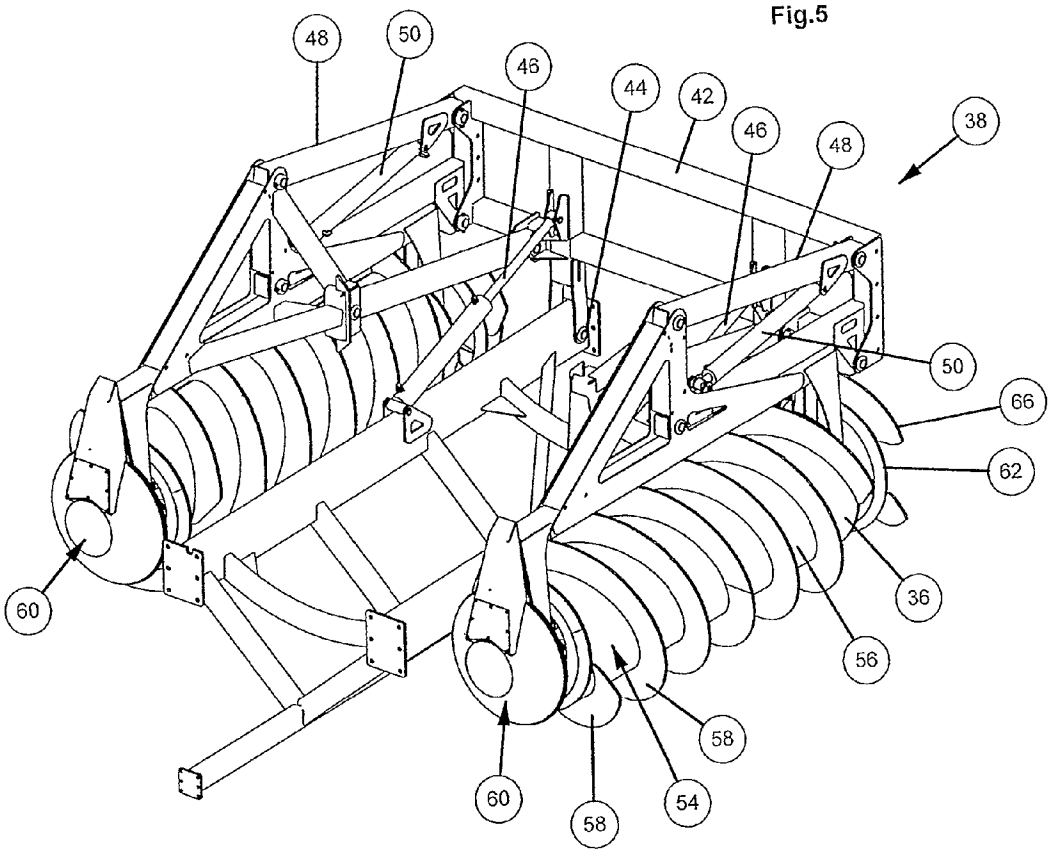
FIG. 5 is a perspective view of the present invention mounted on the distal end of a boom.

Turning now to FIG. 5, the augers 36 are carried on a subframe 38. The subframe 38 has a first member 42 which is pivotally connected to the boom 30 at a first pivot point 44. Adjustment of the angle between the first member 42 and the boom 30 is controlled by operation of a first hydraulic cylinder 46.

The elevation of the auger 36 relative to the cutter head 28 can be adjusted by raising or lowering the three bar linkage 48 through operation of a second hydraulic cylinder 50. The elevation of each auger 36 can be adjusted independent of the other by operating the second hydraulic cylinder 50 of each three bar linkage 48. By being able to independently adjust both the pitch and elevation of the augers 36 the present invention has the ability to insure that the augers 36 remain in optimal contact with the bottom of the body of water being dredged thus providing the maximum amount of force for positioning the cutter head 28 and dredge 20 in a desired position as well as travel over uneven terrain.

In another embodiment of the present invention the pair of second hydraulic cylinders 50 can be in parallel on the hydraulic circuit. This would allow the elevation of the augers 36 relative to the boom 30 to adjust automatically in response to the force put on the augers 36. This would provide constant even contact between the augers 36 and the bottom of the body of water without adjustment by the operator. However it might be necessary to provide a constant resistance to the second hydraulic cylinders 50 to maintain a level elevation of the augers 36 relative to the boom 30 as the boom 30 is raised and lowered. This resistance could be provided by a spring biased against the operation of the second hydraulic cylinders 50.

The first pivot point 44 in the preferred embodiment is actually a pair of parallel pivot points. While it is possible to construct the present invention with a single first pivot point 44, the use of two or more pivot points along a common axis prevents twisting of the subframe 38 relative to the boom 30.

The preferred embodiment as seen in FIGS. 1-5 has a pair of parallel mounted augers 36 mounted on the sub frame. It may be possible to practice the present invention with additional augers 36.

Further the preferred embodiment of the invention shown in FIGS. 1-5 has both augers 36 and their three bar linkages mounted to the same first member 42. In certain applications it may be beneficial to have two first members 42 each independently mounted to the boom 30. In this embodiment each first member 42 would have its own first hydraulic cylinder 46. Each first hydraulic cylinder 46 would be operable independent of the other first hydraulic cylinder 46. This would allow the pitch of each auger 36 relative to the boom 30 to be adjusted individually.

Each auger 36 has a cylindrical body 52 with an interior volume 54 and an exterior surface 56. Each auger 36 has one or more flights 58 secured to the exterior surface 56. The body 52 can be constructed such that the interior volume 54 is sealed to prevent water from entering it. Similarly the body 52 could be constructed to allow the interior volume 54 to fill with water when submerged and to drain when lifted out of the water. Each auger 36 is independently operated by a hydraulic motor 60. The auger 36 can also be equipped with conical shaped end pieces 62 having an exterior surface 64 with flights 66.

In the preferred embodiment each auger 36 has three individual flights 58 with a pitch of 36 inches. Further in the preferred embodiment the auger 36 and hydraulic motor 60 have the ability to operate from 0 to at least 200 rpms (revolutions per minute). However depending upon operating conditions the number of flights 58 and their pitch as well as the rotational speeds of the auger 36 may be varied.

The foregoing description details certain preferred embodiments of the present invention and describes the best mode contemplated. It will be appreciated, however, that changes may be made in the details of construction and the configuration of components without departing from the spirit and scope of the disclosure. Therefore, the description provided herein is to be considered exemplary, rather than limiting, and the true scope of the invention is that defined by the following claims and the full range of equivalency to which each element thereof is entitled.

What is claimed is:

1. A dredge propulsion system for use on a dredge with a cutter head mounted on a boom, said propulsion system comprising:

an auger assembly attached to said boom a sub frame with a first member, a first pivot point and a three bar linkage;

wherein said auger assembly is attached to said boom by said subframe and said first member is attached to the boom through said first pivot point and said three bar linkage is mounted on said first member and said auger is carried by said three bar linkage.

2. The dredge propulsion system of claim 1, further comprising:

a first hydraulic cylinder mounted between the boom and said first member;

wherein the activation of said first hydraulic cylinder alters the angle of the first member relative to the boom.

3. The dredge propulsion system of claim 1, further comprising:

a second hydraulic cylinder mounted to the three bar linkage;

wherein the activation of said second hydraulic cylinder alters the elevation of said auger assembly relative to the boom.

4. The dredge propulsion system of claim 1, said auger assembly comprising a pair of augers mounted parallel to one another.

5. The dredge propulsion system of claim 4, further comprising said augers being independently driven.

6. The dredge propulsion system of claim 4, each said auger comprising:

a drum with an interior volume, an exterior surface and at least one flight located on said exterior surface.

7. The dredge propulsion system of claim 6, wherein said interior volume is sealed.

8. The dredge propulsion system of claim 6, said auger further comprising at least one conical shaped end piece with a flight located on an outer surface.

9. The dredge propulsion system of claim 4, further comprising the flighting of the augers are in opposite rotation from one another.

10. A dredge propulsion system for use on a dredge with a cutter head mounted on a boom, said propulsion system comprising:

a pair of parallel mounted augers each with a drive motor;

a subframe with a first member, a first pivot point, a three bar linkage, a first hydraulic cylinder and a second hydraulic cylinder;

wherein said first member is attached to the boom through said first pivot point and said three bar linkage is mounted on said first member and said pair of augers are carried by said three bar linkage; and an angle of said first member relative to the boom can be varied through operation of said first hydraulic cylinder and an elevation of said augers relative to the boom can be varied through operation of said second hydraulic cylinder.

* * * * *